US005820353A

United States Patent [19]

Beylich et al.

[11] Patent Number: 5,820,353

[45] Date of Patent: Oct. 13, 1998

[54] APPARATUS AND PROCESS FOR OPERATING JET PUMP FROM WHICH A DRIVING MEDIUM EXITS AT SUPERSONIC SPEED

[75] Inventors: Alfred E. Beylich; Martin Blanke, both of Aachen, Germany

[73] Assignee: Mannesmann Aktiengesellschaft, Düsseldorf, Germany

[21] Appl. No.: 765,389

[22] PCT Filed: Jul. 5, 1995

[86] PCT No.: PCT/DE95/00923

§ 371 Date: Jan. 6, 1997

§ 102(e) Date: Jan. 6, 1997

[87] PCT Pub. No.: WO96/01374

PCT Pub. Date: Jan. 18, 1996

[30] Foreign Application Priority Data

Jul. 6, 1994 [DE] Germany ..... 44 25 601.9

[51] Int. Cl.[6] ..... F04F 5/44

[52] U.S. Cl. ..... 417/198; 417/187; 417/151; 239/590

[58] Field of Search ..... 417/151, 54, 187, 417/196, 198; 239/590, 601

[56] References Cited

U.S. PATENT DOCUMENTS 3,143,293 8/1964 Purse ..... 417/198
3,774,846 11/1973 Schurig et al. ..... 239/102

FOREIGN PATENT DOCUMENTS 716432 3/1931 France ..... 417/151

*Primary Examiner*—Timothy Thorpe
*Assistant Examiner*—Cheryl J. Tyler
*Attorney, Agent, or Firm*—Cohen, Pontani, Lieberman & Pavane

[57] ABSTRACT

A process for operating a jet pump with a driving nozzle from which a driving medium, especially steam, exits at supersonic speed, this driving medium mixing with a gaseous load medium. According to the invention, downstream of the outlet of the nozzle in the mixing region the circumferential length is increased by a cross-sectional shape of the driving jet diverging from the circle in order to eliminate the azimuthal symmetry of the vortex structure of the driving medium, wherein the respective cross-sectional surface corresponding to the principle of continuity beginning in the jet direction with a circular cross section in the supersonic portion of the jet corresponds to the circular cross-section surface of the driving medium in conventional supersonic nozzles. The invention is further directed to a jet pump, especially a steam jet pump, with a jet nozzle which widens from the neck to its end and is enclosed by a coaxially arranged mixing chamber and, a conically tapering diffuser portion adjoining the latter. This jet pump is characterized in that the cross-sectional shape of the widening portion (13) of the jet nozzle (10) is so formed by a neck (12) of the transonic portion having a circular cross section (Ak) with corresponding circumferential length (Lk) downstream of the jet that the circumference has a greater length (Lx) compared with the circular shape in a given cross-sectional surface (A), and at least three carrugations or beads (18) extending in the jet direction are provided in the casing (19) of the jet nozzle.

10 Claims, 3 Drawing Sheets

APPARATUS AND PROCESS FOR OPERATING JET PUMP FROM WHICH A DRIVING MEDIUM EXITS AT SUPERSONIC SPEED

FIELD OF THE INVENTION

The invention is directed to a jet pump and process for operating the jet pump with a driving nozzle from which a driving medium, especially steam, exits at supersonic speed and is mixed with a gaseous load medium.

BACKGROUND OF THE INVENTION

In jet pumps in which a high-speed jet of driving fluid exerts a suction effect on a driven or pumped fluid and, in so doing, entrains this fluid, the driving fluid imparts kinetic energy to the driven fluid by mixing of streams and by transfer of momentum so that a mixed jet of both fluids has a lower velocity at the end of the mixing process than the jet of entraining or driving fluid. The high velocity required for the driving fluid for this purpose is achieved in that pressure energy is transformed into kinetic energy in a so-called injection nozzle or driving nozzle. Finally, the remaining kinetic energy of the mixed jet is transformed into pressure energy again in a diffuser.

The driving fluid and driven fluid are chiefly gaseous media and vaporous media. The final velocity of a gaseous or vaporous driving medium is considerably greater than the speed of sound in jet pumps with high capacity and with a high pressure ratio. This is achieved by means of a cross-sectional widening in the supersonic portion of the nozzle so that potential energy is transformed into kinetic energy in conjunction with a simultaneous pressure drop. Supersonic nozzles generally have a circular cross section with a conical or contoured supersonic portion.

A steam jet pump in which the working steam is ejected from a jet nozzle widening toward the end is described in German Patent publication 3406201A 1 . The working steam achieves its critical velocity, i.e., speed of sound, when passing through the neck portion of the nozzle. Since the steam passes through the widening portion of the nozzle, the pressure energy is completely transformed into kinetic energy and the steam is ejected into a chamber at supersonic speed.

With the great differences in velocity between the load mass flow and the driving mass flow, the mixing process in high-capacity jet pumps is inefficient and slow using this known jet pump design. This results in losses in the process, particularly friction losses, and an excessively large construction length of the jet pump or incomplete mixing and accordingly output losses. It is not possible to manipulate the supersonic flow in the supersonic core jet as is possible, for example, in the subsonic region, e.g., by means of interference bodies initiating turbulence, in view of the considerable losses due to compression shocks.

The usual increase in the mixing area between the driving or primary jet and the secondary jet effected in jet engineering by means of rosette-shaped nozzles, known as hypermixing, is possible only in the subsonic region. In the hypersonic region, such a step would immediately lead to destruction of the jet momentum due to compression shocks resulting in failure of the pump.

THE SUMMARY OF THE INVENTION

The object of the present invention is to provide a jet pump and process for operating the jet pump in which an increase in the mixing of driving medium and load medium is achieved in a simple design.

This object is met by the present inventive process for operating a jet pump with a driving nozzle from which a driving medium, especially steam, exits at supersonic speed and mixes with a gaseous load medium. Downstream of an outlet of the nozzle in the mixing region the circumferential length is increased by a cross-sectional shape of the driving jet deviating from the circle in order to eliminate azimuthal symmetry of a vortex structure of the driving medium, so that the respective cross-sectional surface, in accordance with the principles of continuity, begins in a jet direction with a circular cross section in a supersonic portion of the jet corresponding to the circular cross-sectional surface of the driving medium in conventional supersonic nozzles.

In addition, the object is met by a jet pump device, especially a steam jet pump, including a jet nozzle which widens from the neck to its end and which is enclosed by a coaxially arranged mixing chamber with a conically tapering diffuser portion adjoining the latter. The cross-sectional shape of the widening portion of the jet nozzle is so formed by a neck of the transonic portion having a circular cross section with corresponding circumferential length downstream of the jet that the circumference has a greater length compared with the circular shape in a given cross-sectional surface and at least three beads extending in the jet direction provided in the casing of the jet nozzle.

In conventional supersonic jets, vortex structures which move in the direction of flow toroidally with azimuthal symmetry are generated at the mixing boundaries downstream of the nozzle end cross section. This azimuthal symmetry is influenced according to the invention without destroying the supersonic flow by generating vortex structures which are as large as possible and which lead to improved mixing and an expansion of the mixing zone. The interaction between these vortex structures having an axis of rotation in the direction of flow and toroidal eddies commonly generated, that is, eddies with an azimuthal rotational axis, leads to pulsating, unsteady processes. The circumferential length of the respective cross-sectional shape is increased while retaining the cross-sectional surface in comparison with the respective circular cross section and accordingly while retaining the mass throughput per second and local status (pressure, temperature, Mach number). Proceeding from the circular cross section in the transonic portion of the driving nozzle, corrugations or beads in the form of bulges or dents are provided downstream in the supersonic portion at the outer surface of the nozzle. These corrugations or beads are rounded at their apex. The cross-sectional surfaces can have the shape of a rounded triangle, square or polygon, e.g., hexagon. Downstream of these beads, are vortices, the rotational axes of which face in the direction of flow, which improve the mixing process in the difficult case of supersonic mixing. When using a steam jet pump with a fluid pressure or medium pressure of 10 bar to 12 bar, the speed of the driving medium reaches 4.8 to 5.2 times the speed of sound in such supersonic nozzles (hypersonic state).

In order to prevent thick boundary layers and compression nozzles, the corrugation or bead-shaped bulges or dents are advantageously rounded at their apex.

In the jet pump according to the invention, the pressure at the nozzle output exceeds the intake pressure of the load medium by a factor of 3 to 5 and the end cross section is correspondingly reduced. Accordingly, the nozzle length can be shorter by a factor of 0.2 compared with the calculated length with complete expansion to the intake pressure. As a result of this step, the intensification of the mixture leads not only to a shorter mixer, but also to an improvement of the pressure ratio by approximately 20%.

An advantageous construction is achieved in a gradually continuous transition from the circular cross section to the end cross section of the supersonic driving nozzle. The change in cross section downstream in the supersonic portion may correspond to the cross section of a conical or contoured nozzle.

BRIEF DESCRIPTION OF THE DRAWINGS

FIG. 2 shows a cross-sectional view of the supersonic driving nozzle of FIG. 2*a* along line III—III;

DETAILED DESCRIPTION OF THE PRESENTLY PREFERRED EMBODIMENTS

Figure 1:
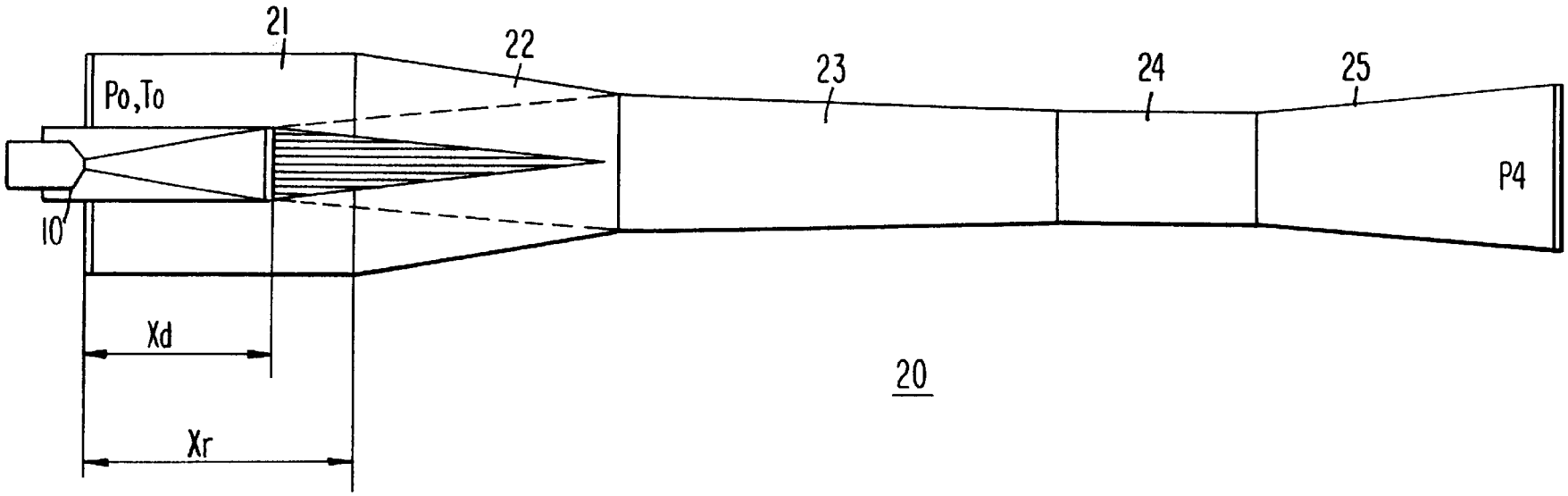
FIG. 1 shows a jet pump in accordance with the present invention.

FIG. I schematically shows the arrangement of a supersonic driving nozzle 10 in a jet pump 20. The jet pump 20 has, arranged one after the other in series from a constructional view point, a cylindrical part 21, a sharply conical part 22 and a slightly conical part 23 of the mixer adjoined by a shock diffuser 24 and a subsonic diffuser 25.

Nozzle 10 has a length Xd and a calculated nozzle length Xr. The initial temperature and initial pressure of a load medium are T0 and P0, respectively, and the final pressure at the output of the pump is P4.

Figure 2:
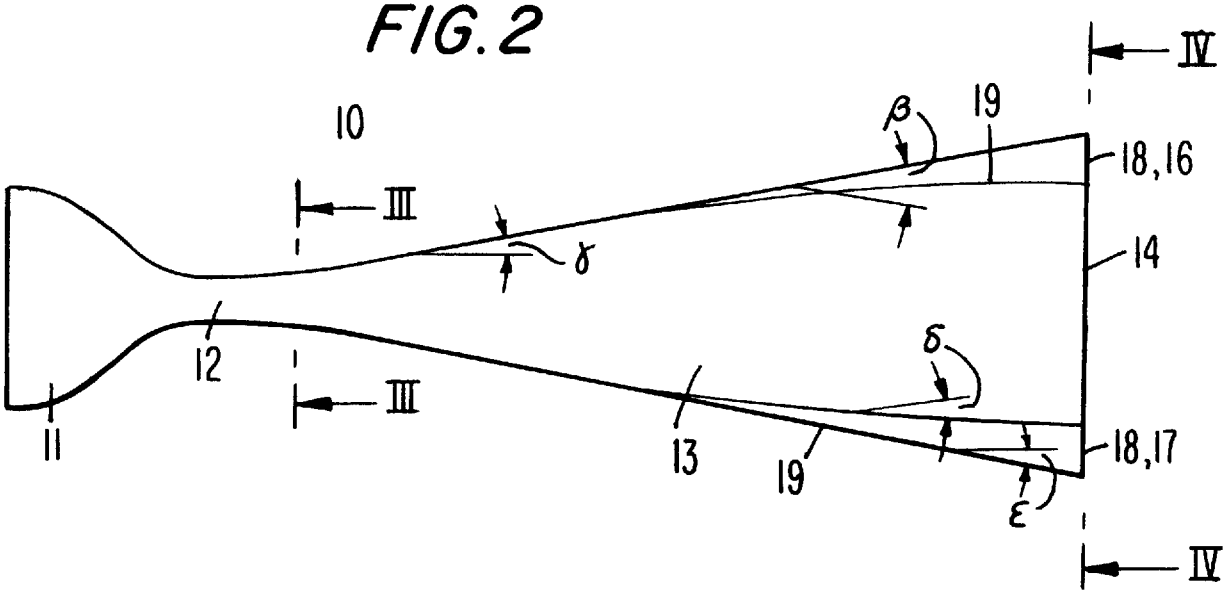
FIG. 2 shows the supersonic driving nozzle of the jet pump of FIG. 1.

FIG. 2 shows a schematic diagram of the supersonic driving nozzle 10. The neck 12 of the transonic region adjoins the entrance of the subsonic portion 11. A widened portion 13 of the supersonic region with the outlet 14 and accordingly with the nozzle end cross section adjoins the neck 12.

Corrugations or beads 18 in the form of bulges 16 having a deformation angle β are provided in the upper portion of the supersonic driving nozzle 10 in the casing 19 which has an angle γ . The deformation angle measured from an apex of the bulge 16 is greater than the casing angle γ of a greater part of the jet nozzle casing 19 by 3° to 5°.

Corrugations or beads 18 in the form of dents 17 having bead angle are provided in the lower region of the supersonic driving nozzle 10 in the casing 19 having angle γ. The bead angle measured from an apex of the dent 17 is smaller than the casing angle δ of a greater part of the jet nozzle casing 19 by 3° to 5°.

Figure 3:
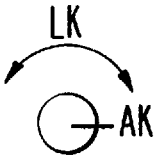

FIG. 3 shows a cross section along line III—III having a circular cross-sectional surface Ak and a corresponding circumferential length Lk.

FIGS. 4*a* through 4*d* show different cross-sectional shapes of the supersonic driving nozzle in FIG. 2 along line IV—IV. The circumferential length Lk in a circular cross section of conventional supersonic nozzles is shown in dashes. In all examples, the cross-sectional surface A of the circular cross section in a conventional supersonic nozzle is equal to that of the nozzle provided with carrugations or beads.

Figure 4A:
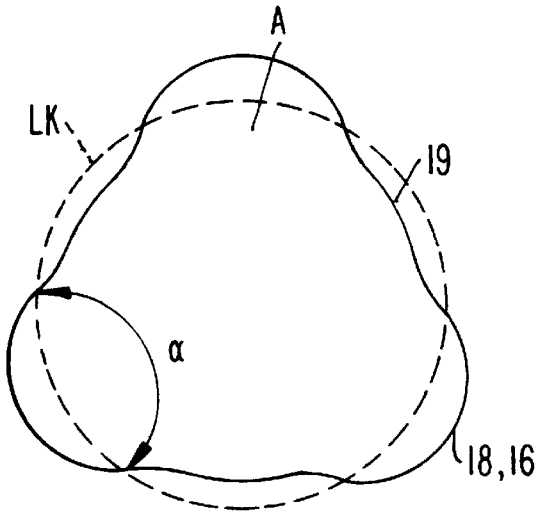
FIGS 4*e* through 4*d* show different cross-sectional shapes of the outlet of the supersonic driving nozzle of FIG. 2*a* along line IV—IV.
Figure 4B:
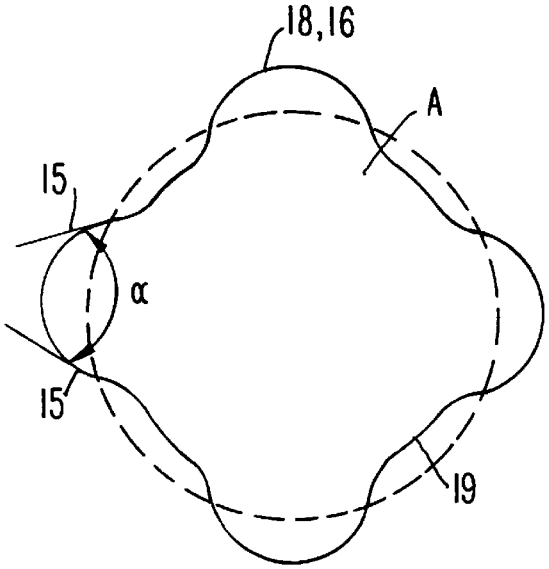
Figure 4C:
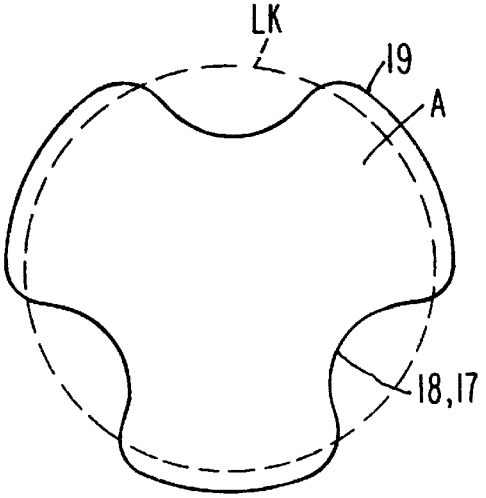
Figure 4D:
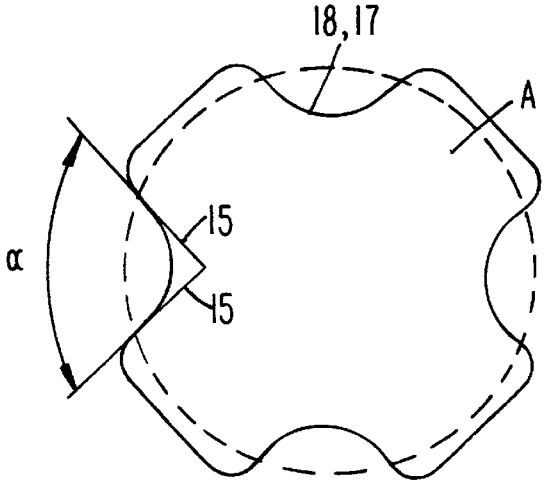

FIGS. 3*a* and 3*b* illustrate examples with three or four beads 18 in the form of bulges 16 in the upper region. Beads 18 in the form of dents 17 in the lower region are illustrated in FIGS. 4*c* and 4*d*. As shown in FIG. 4*d*, legs 15 open at an angle α of at least 60°.

What is claimed is:

1. A process for operating a jet pump including a driving nozzle having a diverging supersonic portion with an outlet from which a driving medium exits at supersonic speed and mixes with a gaseous load medium in a mixing chamber coaxially enclosing the driving nozzle and connected to a conically tapered diffuser, said process comprising the steps of:

increasing a circumferential length of a cross section of the driving nozzle having a predetermined shape by changing the shape of the cross section of the driving nozzle using corrugations extending in a direction of jet flow in order to eliminate azimuthal symmetry of a vortex structure of the driving medium in a mixing area downstream of the nozzle, wherein beginning in the direction of jet flow a cross-sectional surface of the supersonic portion of the nozzle with the corrugations is equal to a respective circular cross-sectional surface at the same cross-sectional locus.

2. The process of claim 1, further comprising the step of generating in the cross section of increased circumferential length a vortex structure having an axis of rotation in a direction of flow.

3. A jet pump comprising:

a jet nozzle having a neck and an outlet, said jet nozzle including a diverging cavity extending from the neck to the outlet thereby defining a supersonic portion therebetween;

a mixing chamber coaxially enclosing said jet nozzle; and a conically tapering diffuser connected to said mixing chamber, the neck having a circular cross sectional shape with a first circumferential length; and means for increasing a circumferential length of a cross section of said nozzle, the neck having a circular cross sectional shape with a first circumferential length and downstream therefrom said nozzle casing having a portion with a non-circular cross sectional shape with a second circumferential length greater than the first circumferential length, and at least three deformations extending in a direction of jet flow within the casing of said jet nozzle;

wherein said nozzle has a length which is shorter than a calculated nozzle length by a factor greater than 0.2 for complete expansion due to intake pressure of a load medium.

4. A jet pump comprising:

a jet nozzle having a neck and an outlet, said jet nozzle including a diverging cavity extending from the neck to the outlet thereby defining a supersonic portion therebetween;

a mixing chamber coaxially enclosing said jet nozzle; and a conically tapering diffuser connected to said mixing chamber, the neck having a circular cross sectional shape with a first circumferential length and downstream of the neck said jet nozzle casing having a portion with a non-circular cross sectional shape with a second circumferential length greater than the first circumferential length, and at least three deformations extending in a direction of jet flow within the casing of said jet nozzle;

wherein said jet nozzle has a length which is shorter than a calculated nozzle length by a factor greater than 0.2 for complete expansion due to intake pressure of a load medium.

5. The jet pump of claim 4, wherein the jet nozzle casing gradually and continuously transitions from the circular cross section of the neck to an end cross section including the carrugations.

6. The jet pump of claim 5, wherein the carrugations are one of bulges and dents having a rounded apex and legs which are separated by an angle of greater than 60°.

7. The jet pump of claim 6, wherein the deformation is a bulge and a corrugation angle measured from an apex of the bulge is greater than a casing angle of a greater part of the jet nozzle casing by 3° to 5°.

8. The jet pump of claim 6, wherein the carrugations is a dent and a bead angle measured from an apex of the dent is smaller than a casing angle of a greater part of the jet nozzle casing by 3° to 5°.

9. The jet pump of claim 4, wherein the jet pump is a steam jet pump.

10. The jet pump of claim 4, wherein the supersonic portion of the of the jet nozzle with the corrugations has a cross-sectional surface equal to a respective circular cross-sectional surface at the same cross-sectional locus.

* * * * *